US006837455B2

(12) United States Patent
Eckhard et al.

(10) Patent No.: US 6,837,455 B2
(45) Date of Patent: Jan. 4, 2005

(54) APPARATUS AND SYSTEM FOR QUICKLY INSERTING OR REMOVING AND HOLDING A ROLL OF TOILET PAPER

(76) Inventors: John L. Eckhard, 3844A Utah Pl., St. Louis, MO (US) 63116; Arthur L. Loeffelman, #8 Daybreak, St. Louis, MO (US) 63128

( * ) Notice: Subject to any disclaimer, the term of this patent is extended or adjusted under 35 U.S.C. 154(b) by 30 days.

(21) Appl. No.: 10/115,801

(22) Filed: Apr. 3, 2002

(65) Prior Publication Data

US 2002/0145074 A1 Oct. 10, 2002

Related U.S. Application Data

(60) Provisional application No. 60/282,292, filed on Apr. 9, 2001.

(51) Int. Cl.[7] ..... B65H 16/06
(52) U.S. Cl. ..... 242/596.4; 242/596.7
(58) Field of Search ..... 242/596.4, 596.7

(56) References Cited

U.S. PATENT DOCUMENTS

| | | | | |
|---|---|---|---|---|
| 2,528,055 A | | 10/1950 | Hartley et al. | |
| 2,879,012 A | * | 3/1959 | Sarro | 242/596.4 |
| 2,905,404 A | | 9/1959 | Simmons | |
| 3,220,660 A | | 11/1965 | Bolger | |
| 3,584,817 A | | 6/1971 | Shanaman | |
| 3,878,998 A | | 4/1975 | Lazzari | |
| 4,009,529 A | | 3/1977 | Johnson | |
| 4,452,403 A | | 6/1984 | Arronte | |
| 4,614,312 A | | 9/1986 | Del Pino | |
| 4,634,067 A | | 1/1987 | White | |
| 4,662,576 A | | 5/1987 | Paul | |
| 5,253,818 A | | 10/1993 | Craddock | |
| 5,868,347 A | | 2/1999 | Paul et al. | |
| 5,878,976 A | | 3/1999 | Duck | |
| 6,189,828 B1 | | 2/2001 | Reilly | |

OTHER PUBLICATIONS

Maddak, Inc.—Instruction brochure for snap and roll product.

* cited by examiner

*Primary Examiner*—John Q. Nguyen
(74) *Attorney, Agent, or Firm*—Kevin L. Klug

(57) ABSTRACT

An apparatus and system for quickly inserting or removing and holding a roll of toilet paper along with its method of use which provides rollmounts which flex when a toilet paper or paper towel roll is pushed into the rollholder onto which each rollmount is installed. The rollmounts retract into the cylinder of the paper roll during use and flex out of the cylinder when the roll is removed. The apparatus and method allows for easy and convenient installation and removal of a roll with the use of one hand. The apparatus is usable in conjunction with existing toilet paper or paper towel roll dispensers or may be used apart with its own "U" shaped form.

16 Claims, 9 Drawing Sheets

APPARATUS AND SYSTEM FOR QUICKLY INSERTING OR REMOVING AND HOLDING A ROLL OF TOILET PAPER

This application claims priority of Provisional Patent Application #60/282,292, filed Apr. 9, 2001.

BACKGROUND OF THE INVENTION

The present invention relates in general to toilet paper or paper towel holders and more particularly to holders which provide quick and easy installation and removal of toilet paper or paper towel rolls. The present invention represents a roll holding apparatus and accompanying method for quickly inserting a roll of said material into a roll holder and thereafter, when the paper is expended, quickly removing the same roll from the roll holder. The apparatus represents an improvement over the prior art by allowing quick insertion or removal of a roll of material with one hand. Furthermore, the apparatus retrofits into and with existing roll dispensers or rollholders or may be used with a separate "U" shaped form.

Conventional roll dispensers or roll holders typically comprise a U-shaped bracket having a wall attaching portion (s), two projecting rollholder arms, and a removable roller with spring biased ends. With a conventional roll dispenser or roll holder, the removable roller is inserted into the cylindrical tube of the paper roll and the spring biased ends snap into depressions within the projecting rollholder arms. The aforesaid removable roller placement within said depressions is often time consuming, inconvenient, and tedious. Moreover, it usually requires the use of two hands, thereby prohibiting persons with only one usable hand from installing said roller.

Unlike the prior art, the present invention provides a quick, easy, and convenient apparatus and method to insert or remove a roll of material such as toilet tissue paper into and out of a rollholder, without the aforementioned inconveniences of the conventional roll dispenser or rollholder. The present invention further provides an apparatus and method for retrofitting the conventional roll dispenser or rollholder with one or more rollmounts which provide the aforementioned means for quick, easy, and convenient insertion or removal of a roll of material such as toilet tissue paper.

The apparatus comprises in its most basic form a pair of rollmounts each having a base, a living hinge, a return tensioner, and a roll engaging arm all molded and formed together. Each rollmount is capable of mounting upon and with a rollholder arm. In an alternate embodiment, the apparatus comprises, again in its most basic form, a base, a connector post mounted onto and extending from said base, a living hinge, a return tensioner, a roll engaging arm and a retrofit plug, again molded and formed together except for the retrofit plug. Again, each rollmount is capable of mounting upon and with a rollholder arm. A further alternative embodiment incorporates a sleeve, preferably formed from an elastomer material, having two oppositely facing pockets for mounting the present art upon the rollholder arm. A still further alternative embodiment incorporates the aforementioned rollmounts as part of a one piece "U" shaped form which attaches within the cavity created by the rollholder or apart from said rollholder, preferably with screws or adhesive. The apparatus in its preferred and alternative forms is presented and claimed alone and in conjunction with a rollholder arm.

Accordingly, it is an object of the present invention to provide an apparatus and system for quickly inserting or removing and holding a roll of toilet paper or paper towels which allows a user to quickly install or remove a toilet paper roll with a single hand.

Another object of the present invention is to provide an apparatus and system for quickly inserting or removing and holding a roll of toilet paper or paper towels which may be utilized with or retrofitted to an existing or pre-installed rollholder without removal of said rollholder.

A further object of the present invention is to provide an apparatus and system for quickly inserting or removing and holding a roll of toilet paper or paper towels which is capable of installation with a minimum of tools.

A still further object of the present invention is to provide an apparatus and system for quickly inserting or removing and holding a roll of toilet paper or paper towels which is capable of inexpensive and high volume manufacture.

A still further object of the present invention is to provide a method for quickly inserting or removing and holding a roll of toilet paper or paper towels in conjunction with the apparatus of the present art which can be utilized by persons having use of only one hand.

SUMMARY OF THE INVENTION

To accomplish the foregoing and other objects of this invention there is provided an apparatus and system for quickly inserting or removing and holding a roll of toilet paper or paper towels along with a method of use. In a preferred embodiment the apparatus comprises in its most basic form a pair of rollmounts each having a base, a living hinge, a return tensioner, and a roll engaging arm all molded and formed together. Each rollmount is capable of mounting upon and with a rollholder arm. In an alternate embodiment, the apparatus comprises, again in its most basic form, a base, a connector post mounted onto and extending from said base, a living hinge, a return tensioner, a roll engaging arm and a retrofit plug, again molded and formed together except for the retrofit plug. Again, each rollmount is capable of mounting upon and with a rollholder arm. The apparatus in its preferred and alternative forms is claimed alone and in conjunction with a rollholder arm. A further alternative embodiment incorporates a sleeve, preferably formed from an elastomer material, having two oppositely facing pockets for mounting the present art upon the rollholder arm. A still further alternative embodiment incorporates the aforementioned rollmounts as part of a one piece "U" shaped form which attaches within the cavity created by the rollholder or as a standalone unit, preferably with screws or adhesive. Further alternative embodiments contemplate use of only one rollmount in conjunction with a post or extension from one of said depressions within said rollholder arms. The rollmounts of the present invention are claimed within alternative embodiments in combination with the rollholder.

The aforesaid rollholder is a staple item used to hold toilet paper or paper towels which typically embodies a contiguously formed or a two piece wall attaching section and a rollholder arm section. The wall attaching section attaches to a wall or other surface and typically holds the rollholder arm sections substantially perpendicular to said wall or surface. The rollholder arm section has an interior side, an exterior side, and a holder end opposite said wall attaching section. Said holder end is typically placed opposite the wall or surface and said wall attaching section and further typically contains depressions on said interior side. Each rollholder arm may be provided by an existing conventional roll dispenser or rollholder or specially manufactured in conjunction with the art of the present invention. In use, two rollholder arms are attached to a wall or surface in mutually opposite positions with the interior sides of the rollholder arms facing each other. Said conventional rollholder arms are typically mirror images of one another.

In a preferred embodiment, the base of each rollmount adhesively attaches to the interior side of each rollholder arm near the holder end of the arm section and over the aforementioned depressions. Said base is of substantially flat shape and has a top side, a bottom side, a front edge, a rear edge, a top edge, a bottom edge, a slotted portion in said front edge where said return tensioner attaches, and a hinged portion. The bottom side is generally flat and preferably adhesively attachable to the interior side of the rollholder arm section with a double sided adhesive foam tape such as the number 4932 Scotch Brand® from 3M® or an equivalent. Alternative embodiments may utilize any form of adhesive which provides sufficient strength to hold said base in position or any type of double sided adhesive tape which provides the same. Further alternative embodiments may attach the base with screws, snaps, or by further modifying the base as described herein. Alternative embodiments of the base include but are not limited to any shape or structure that provides an attachable surface for mounting the base to a rollholder arm.

In another alternate embodiment, a connector post is attached to the bottom side of the rollmount base, preferably at the time of molding. Said connector post provides a method of rollholder attachment without the use of adhesives. The connector post extends from said base with a generally rectangular cross section but may have other polygonal cross sections. Said post has a post connecting end and a post attaching end which is opposite the connecting end. Said post attaching end preferably attaches to the back side of the base. The post connecting end preferably contains one or more lips extending therefrom. The lips on said connecting end allow the connector post to snap and hold into and with a retrofit plug.

The retrofit plug comprises a generally cylindrical piece of elastomeric or rubber material, preferably a TPE plastic with a durometer near 70, having a cavity or hole of substantially similar cross section as said connector post. Preferably, though not required, said retrofit plug also has a plurality of ridges on the cylinder's circumferential surface and parallel with the cylindrical long axis. Said ridges compressively engage the depression of said rollholder arm when said plug is inserted within said depression. Alternate embodiments of said retrofit plug include any type and shape of material that allows a secure insertion and hold of said plug within the depression of an existing rollholder arm and further provides for insertion of said connector post.

In a preferred embodiment, the hinged portion of said base is placed near but not at the front edge of said base and is molded with and attaches to the roll engaging arm via the living hinge and the return tensioner. The living hinge is widely understood and utilized within the art of plastic molding. Said living hinge is a plastic material bridge between the base and said roll engaging arm which allows flexing between the two portions without tearing or breakage of said bridge. Typically said living hinge is of a substantially thinner thickness than said base or holder arm and located near said front edge in a direction toward the rear edge of said base and away from a bend in said return tensioner. Numerous other components such as springing mechanical hinges or metallic bridges may be substituted without departing from the spirit of the present invention, although a living hinge is a distinct and unique mechanical element which is uniquely suited for the present application. Nevertheless, the living hinge, preferably of polypropylene, along with the return tensioner provides numerous weight, size, manufacturability, and cost advantages over other methods.

The aforesaid return tensioner further comprises a plastic material bridge between the base and said roll engaging arm having a bend which forms it in a substantially "L" shape, although other shapes may be utilized. It provides the necessary stiffness and flexing material memory for maintaining and positioning the base at a substantially right angle with said roll engaging arm on said living hinge. In a preferred embodiment, the return tensioner is also of substantially thinner thickness than said base or holder arm but of a thicker thickness than said living hinge. Also in a preferred embodiment, said return tensioner attaches within the slotted portion of the base and substantially near the axis of the living hinge. Said return tensioner preferably attaches with said roll engaging arm away from the axis of said living hinge, near a left end and toward a right end of said roll engaging arm, and within a slot within said roll engaging arm.

In a preferred embodiment, the roll engaging arm is of substantially rectangular shape and has a right end, a left end, a top end, a bottom end, a front side, a rear side, a hinged portion, and a slot in said left side into which the return tensioner attaches. In a preferred embodiment, said right end is generally smooth and flat with rounded edges. Said top and the bottom ends preferably each have a rounded edge which provides a smooth bearing surface for a cardboard tube or roll which rests thereon. The hinged portion attaches with the aforesaid living hinge near the left side. Alternate embodiments of the roll engaging arm include but are not limited to any structure which flexibly attaches to the base and is capable of supporting a rotating cardboard tube or roll.

In operation, the rollholder having jointly or separately mounted rollholder arms, whether claimed as part of the apparatus or as a separately non-claimed fixture or staple item, is attached to a wall or surface and oriented so that the interior sides of the rollholder arms face each other. The rollholder arms are spaced horizontally at a length slightly longer than the length of the roll that will be inserted. The bottom side of the base of a rollmount is then attached to the interior side of each rollholder arm in a position which usually covers the depression in said rollholder arm. Said attachment may be via adhesive, adhesive tape, or via the use of the alternative embodiment connector post and retrofit plug placed into said depression of said rollholder arm. When placed as anticipated and described, the front side of said roll engaging arm is facing away from the wall or surface on which the rollholder is placed and said roll engaging arm is capable of flexing toward said wall when pressed in said direction.

Once secured onto the rollholder arms, a roll of toilet paper or other roll material may be pushed between said rollholder arms, thereby flexing said roll engaging arms of said rollmounts toward said wall or surface. When the cylindrical cavity of the roll passes onto the front side of said roll engaging arm of the rollmount, the return tensioner causes said roll engaging arm to retract away from said wall or surface and into said cylindrical cavity of said roll, whereby said roll is secured between the rollholder arms.

When the paper on the cylindrical roll is used, the user simply pushes said cylindrical roll toward the wall or surface in order to disengage the cylindrical roll from said roll engaging arms of said rollmount. That is, when pushed as aforesaid, the roll engaging arms flex toward said wall or surface and allow the cylindrical cavity of the roll to pass over the roll engaging arms and thereby freeing or disengaging the empty roll from the roll engaging arms of said rollmount. Once disengaged the empty roll may be discarded and a new roll may be inserted, all with the use of one hand. Obviously the foregoing provides significant benefits to those persons having use of only one hand.

A further alternative embodiment incorporates a sleeve, preferably formed from an elastomer material, having two oppositely facing pockets for mounting the present art upon the rollholder arm. This further embodiment utilizes the rollmounts of the preferred embodiment yet provides an alternative mounting capability apart from adhesives. That is, the aforementioned rollmount base is placed in a first sleeve pocket and a second sleeve pocket is placed over the holder end of the rollholder arm. Since the sleeve is of an elastomer material such as natural or synthetic rubber, each pocket conforms and holds onto the aforesaid.

A still further alternative embodiment incorporates the aforementioned rollmounts as part of a one piece substantially "U" shaped form which attaches within the cavity created by the rollholder, preferably with screws or adhesive. This embodiment and its advantages is best understood by reference to the aforementioned conventional rollholder. The conventional rollholder forms a substantially "U" shaped form between the interior sides of the rollholder arm portions and the wall or wall attaching section of the rollholder. This further alternative embodiment provides a substantially "U" shape which follows and substantially conforms to the contour of the aforesaid interior "U" of the rollholder arms and rollholder wall attaching section. This alternative embodiment "U" shape may then be attached to the wall or wall attaching section with adhesives, adhesive tape, or conventional fasteners such as screws, bolts, or pins. This alternative embodiment may also provide extensions which mate with the depressions within the rollholder arms. This alternative embodiment functions and performs as the preferred embodiments and may be used as a stand alone unit.

In the aforesaid embodiments, the aforementioned components are composed of molded plastic, preferably polypropylene. Alternate embodiments may be manufactured from and composed of any combination of metal, rubber, plastic, ceramic, or wood which are capable of holding a roll of toilet tissue paper, paper towels, or other such material.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
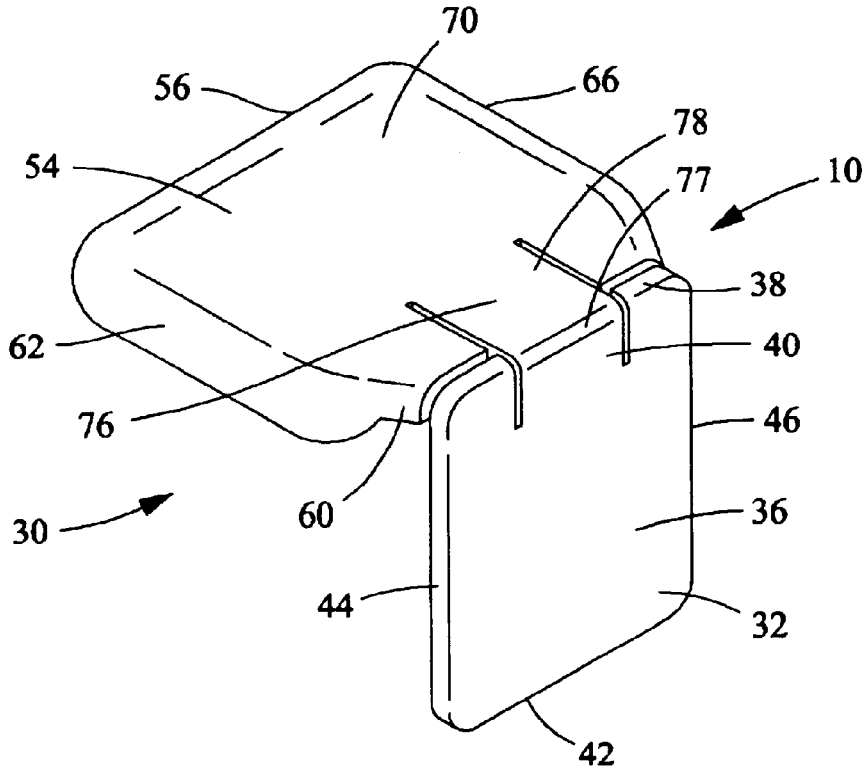
FIG. 1 is a perspective view of a rollmount in its preferred embodiment showing the bottom side of the base, the living hinge, return tensioner and front side of the roll engaging arm.
Figure 2:
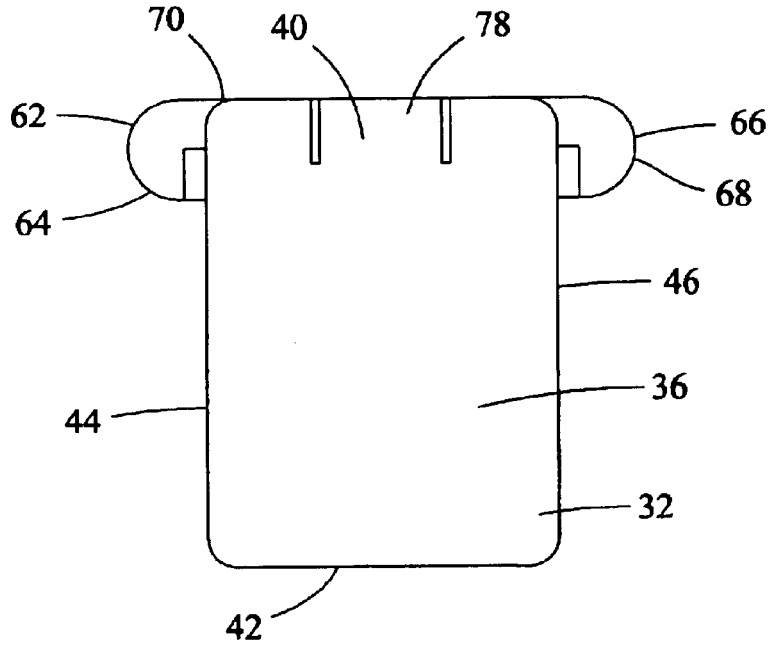
FIG. 2 is a plan view as seen looking on the bottom side of the base of the rollmount in its preferred embodiment.
Figure 3:
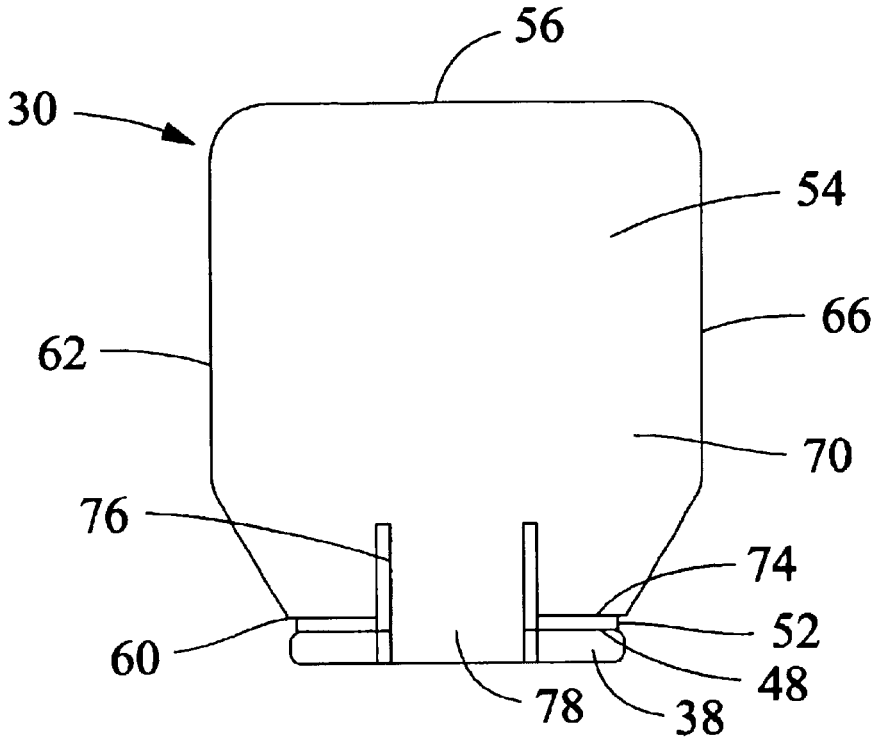
FIG. 3 is a plan view as seen looking on the front side of the roll engaging arm of the rollmount in its preferred embodiment.
Figure 4:
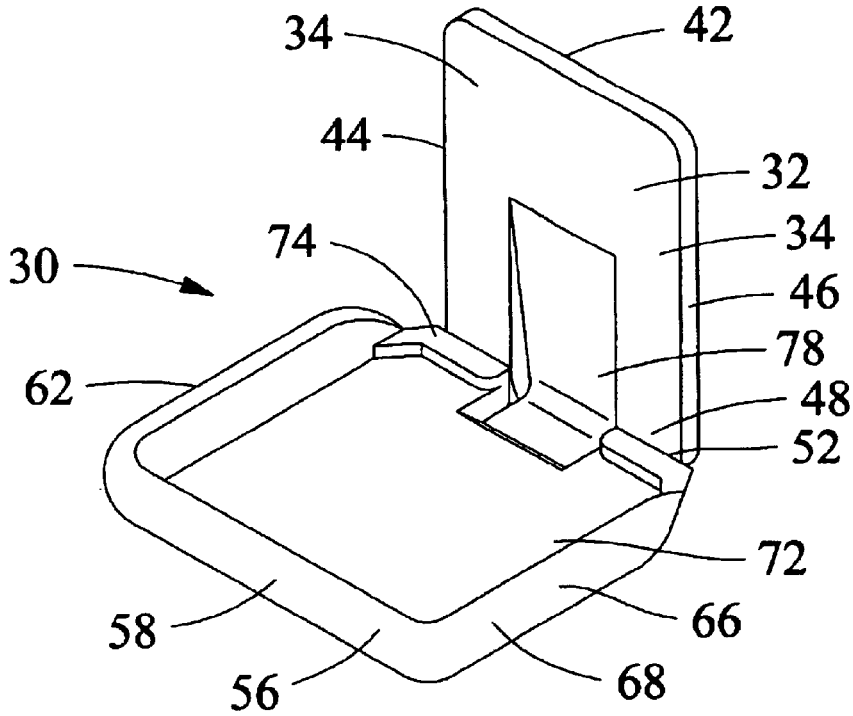
FIG. 4 is a perspective view of a rollmount of a preferred embodiment showing the top side of the base, the rear side of the roll engaging arm, the living hinge, and the return tensioner mounted within the slotted portions of said base and roll engaging arm.
Figure 5:
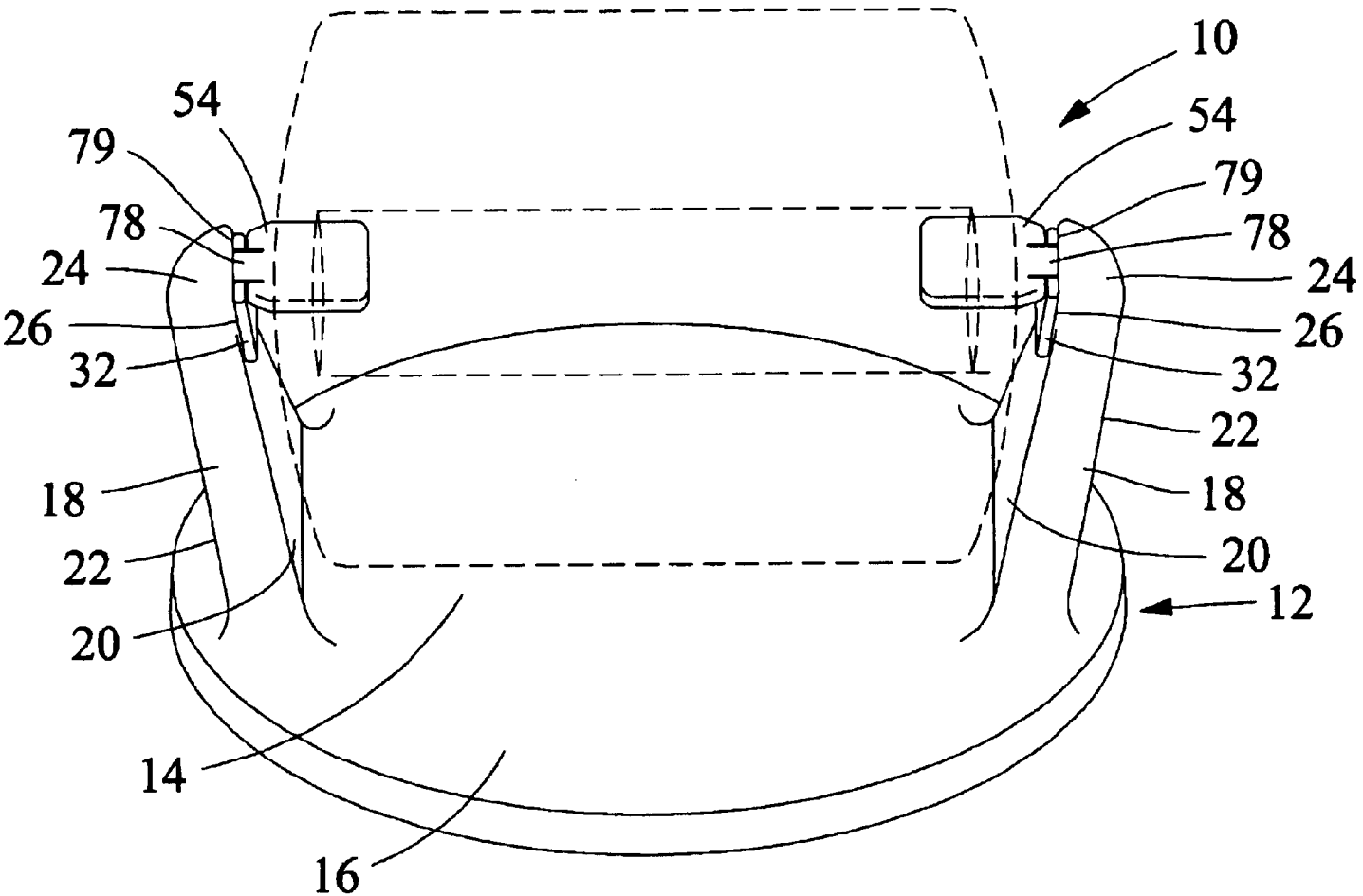
FIG. 5 is a perspective view showing a rollholder with a pair of rollmounts mounted onto the rollholder arms further showing a roll of toilet paper in phantom.
Figure 6:
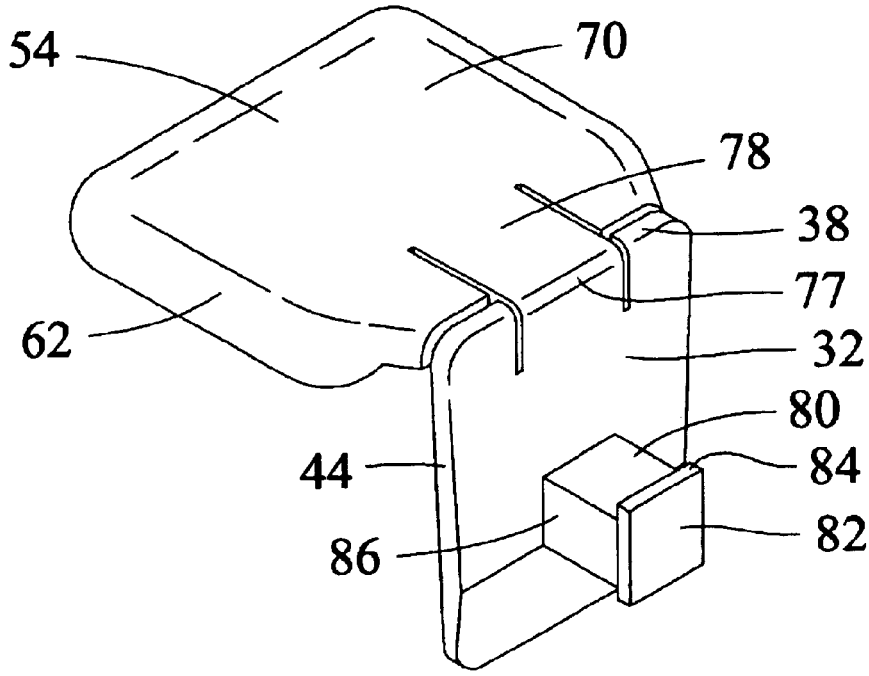
FIG. 6 is a perspective view of a rollmount in an alternative embodiment showing the bottom side of the base having a connector post, the living hinge, return tensioner and front side of the roll engaging arm.
Figure 7:
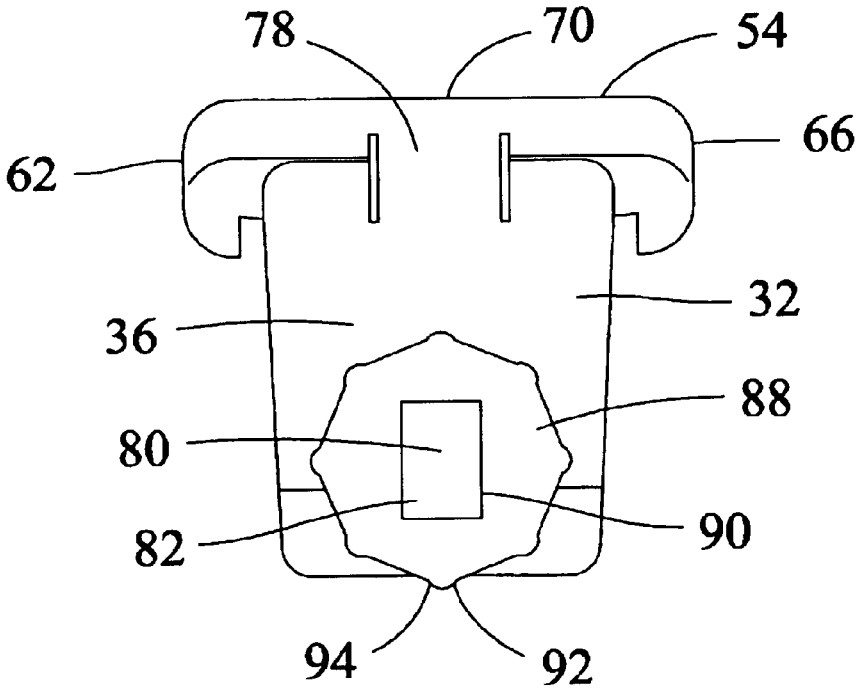
FIG. 7 is a plan view of a rollmount of an alternative embodiment showing the bottom side of the base having a connector post with an attached cylindrical retrofit plug, the living hinge, return tensioner and left end of the roll engaging arm.
Figure 8:
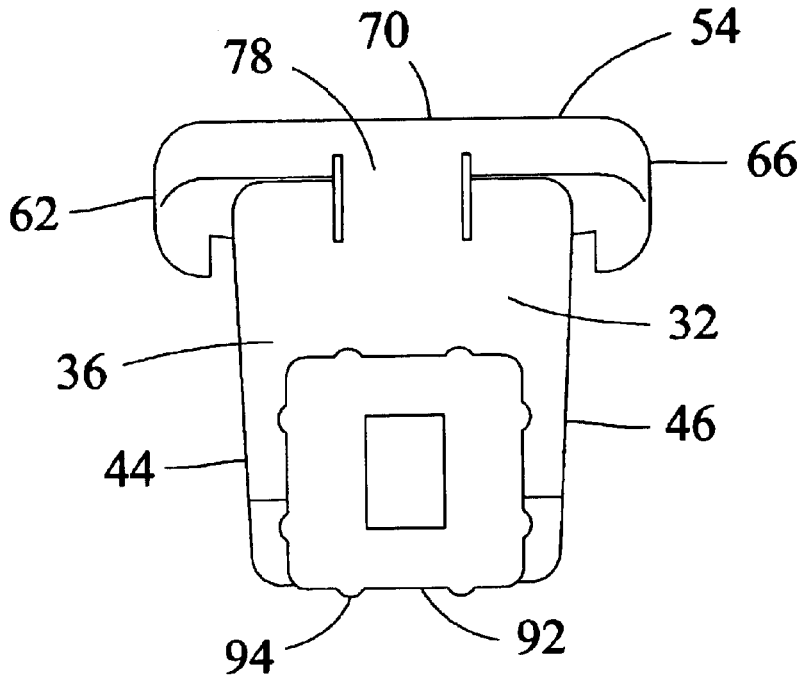
FIG. 8 is a plan view of a rollmount of an alternative embodiment showing the bottom side of the base having a connector post with an attached cubical retrofit plug, the living hinge, return tensioner and left end of the roll engaging arm.
Figure 9:
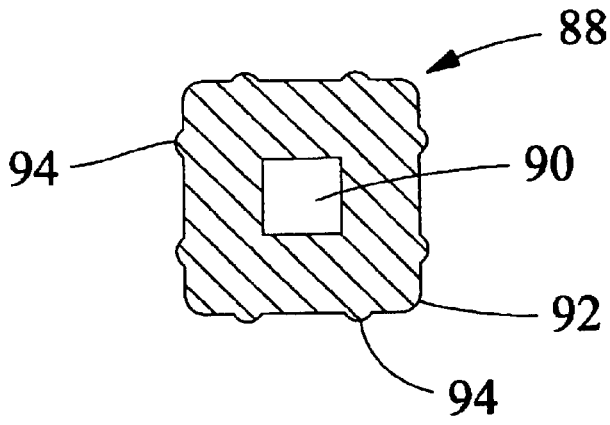
FIG. 9 is a plan view of the cross section of the lengthwise axis of a cubical retrofit plug of FIG. 15 which further shows the ridges along the perimeter.
Figure 10:
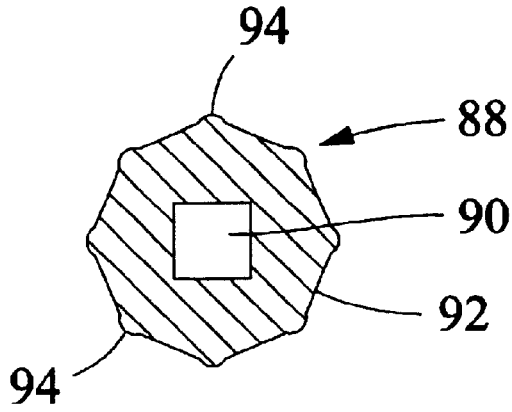
FIG. 10 is a plan view of the cross section of the lengthwise axis of a cylindrical retrofit plug of FIG. 16 which further shows the ridges along the perimeter.
Figure 11:
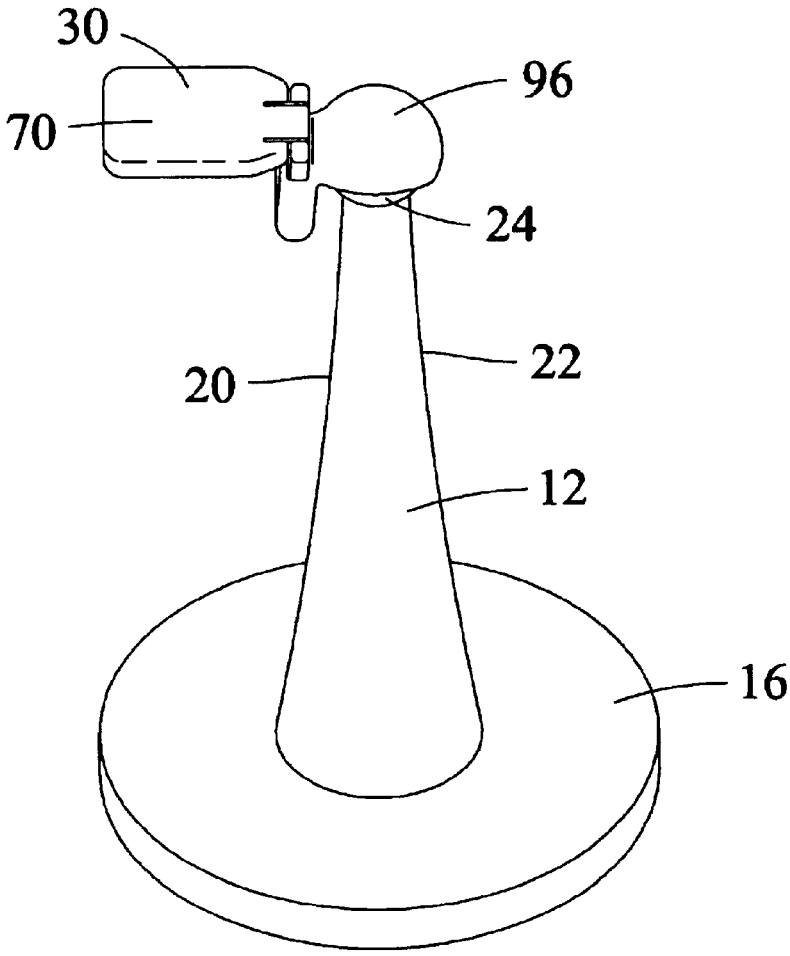
FIG. 11 is a perspective view showing a rollmount of an alternative embodiment with a rollmount mounted onto the rollholder arm with the described elastomer sleeve.
Figure 12:
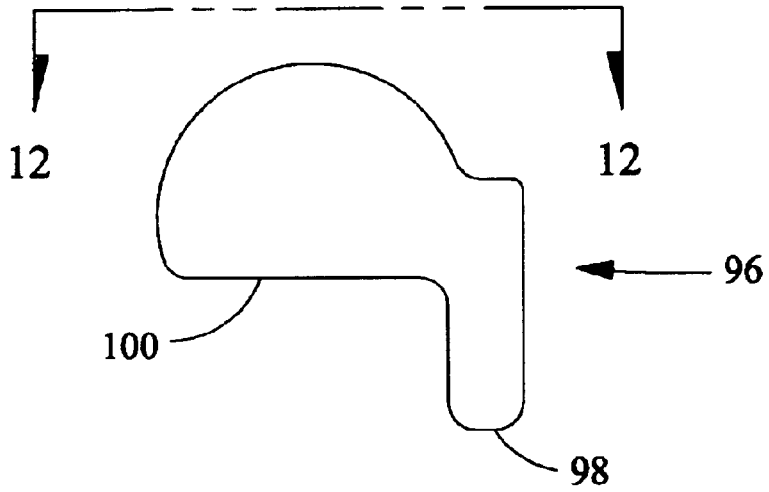
FIG. 12 is a right side view of said elastomer sleeve.
Figure 13:
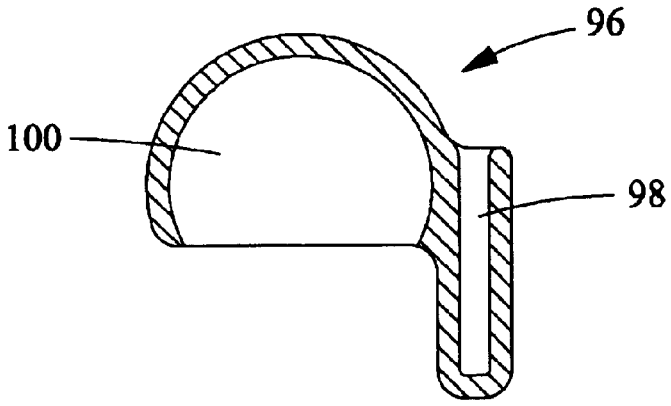
FIG. 13 is a cross sectional view of said elastomer sleeve taken along the plane shown by line 12—12 in FIG. 12.
Figure 14:
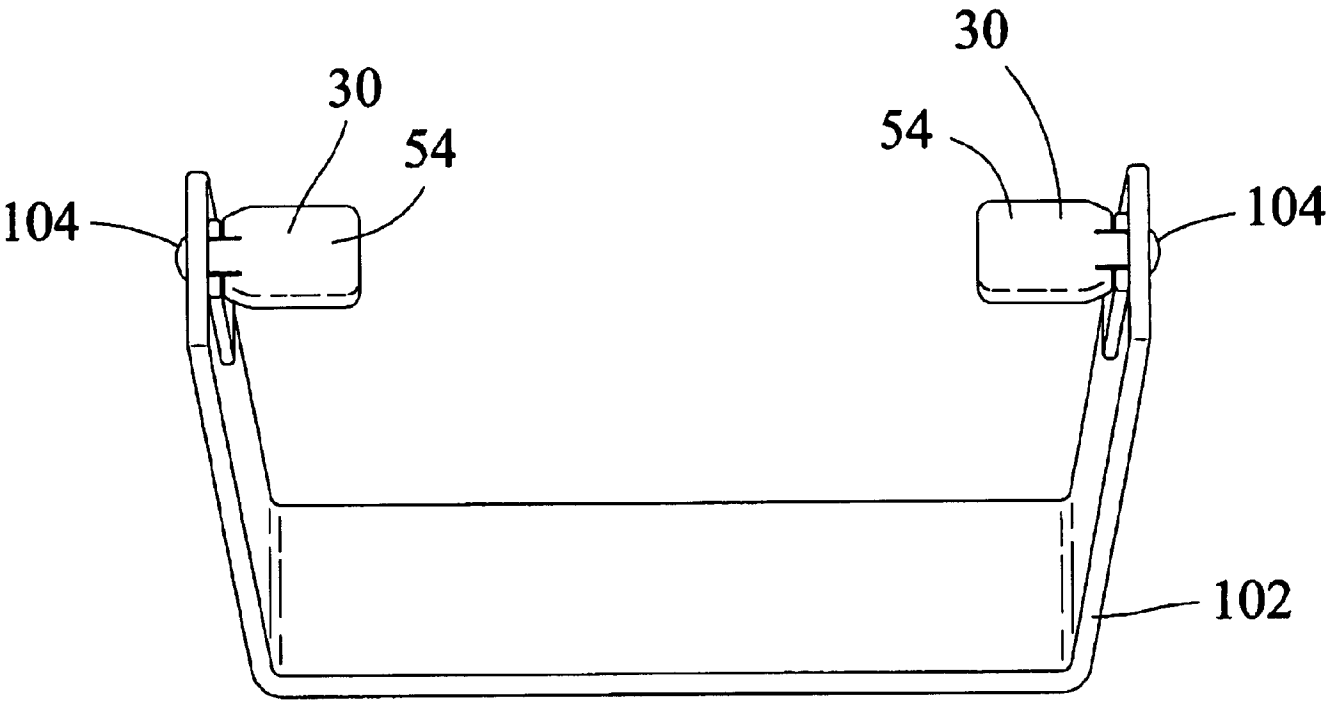
FIG. 14 is a perspective view showing rollmounts of an alternative embodiment incorporated with the described substantially "U" shaped form.
Figure 15:
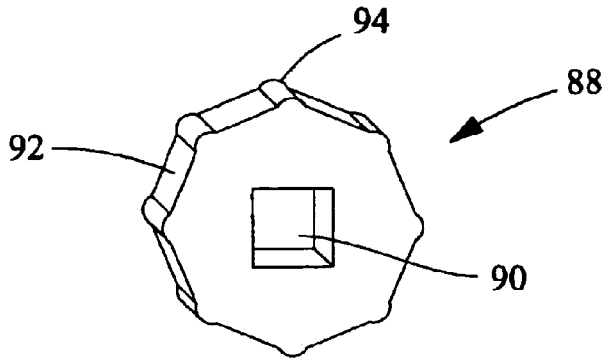
FIG. 15 is a perspective view of the cubical retrofit plug which further shows the ridges along the perimeter.
Figure 16:
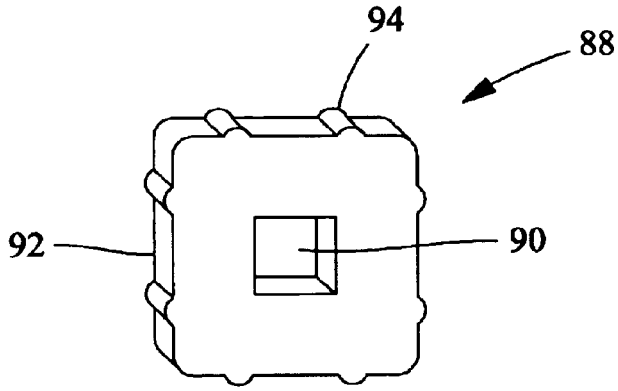
FIG. 16 is a perspective view of the cylindrical retrofit plug which further shows the ridges along the perimeter.

Referring now to the drawings, there is shown in FIGS. 1–4 a preferred embodiment of an apparatus for quickly inserting or removing and holding a roll of toilet paper 10, in FIG. 5 use of the preferred and alternative embodiments of such in conjunction with a rollholder 12 and in FIGS. 6–14 alternative embodiments of such. The apparatus for quickly inserting or removing and holding a roll of toilet paper 10 is particularly adapted for quick, convenient, and single handed installation and removal of toilet paper or paper towel rolls.

The drawings show the apparatus 10 comprising, in its preferred form, two rollmounts 30 mounted with and onto a conventional rollholder 12. Alternative embodiments may incorporate only one rollmount 30 and substitute a post, a peg, or simply the geometric form of the rollholder arm 18 for the other rollmount 30. In the preferred embodiment, each rollmount comprises a base 32 and a roll engaging arm 54 connected via a living hinge 52 and a return tensioner 78 to said base 32. Preferably the aforesaid components are formed together within a single mold but may also be constructed separately and attached via solvent welding, adhesives, or mechanical bonding. The aforesaid base 32 is of substantially flat shape and has a topside 34, bottomside 36, a front edge 38 having a slotted portion 40 where said return tensioner 78 attaches, a rear edge 42, a top edge 44, a bottom edge 46, and a hinged end portion 48. The base 32 may depart from a substantially flat form yet function as further described herein.

In a preferred embodiment, the aforesaid roll engaging arm 54 is of substantially rectangular shape and has a right end 56, a left end 60, a top end 62, a bottom end 66, a front side 70, a rear side 72, an arm hinged portion 74, and a slot 76 in said left end 60 into which the return tensioner 78 attaches. In a preferred embodiment, said right end 56 is generally smooth and flat with rounded edges 58. Said top 62 and bottom 66 ends preferably each have a rounded edge 64, 68 (respectively) which provides a smooth bearing surface for a cardboard tube or roll which rests thereon. The hinged portion 74 attaches with the aforesaid living hinge 52 near the left end 60. Alternate embodiments of the roll engaging arm 54 include but are not limited to any structure or form which flexibly attaches to the base 32 and is capable of supporting a rotating cardboard tube or roll.

Again, each rollmount 30, in its preferred and some alternative forms, is capable of mounting upon and with a rollholder arm 18. The apparatus in its preferred and alternative forms is claimed alone and in conjunction with a rollholder arm 18 of a rollholder 12. The rollholder 12 as a staple item typically comprises a wall attaching section 16, having one or two portions, and the aforesaid rollholder arm section 18. The wall attaching section 16 attaches to a wall or other surface and typically holds the rollholder arm 18 sections substantially perpendicular to said wall or surface. Said wall attaching section 16 may be one piece which connects both rollholder arms 18 or may be two sections one each mounted to each rollholder arm 18. The rollholder arm 18 section has an interior side 20, an exterior side22, and a holder end 24 opposite said wall attaching section 16. Said holder end 24 is typically placed opposite the wall or surface and said wall attaching section 16 and further contains one or more depressions 26 on said interior side 20. Each rollholder arm 18 may be provided by an existing conventional roll dispenser or rollholder or specially manufactured in conjunction with the art of the present invention. In use, two rollholder arms 18 are attached to a wall or surface in mutually opposite positions with the interior sides 20 of the rollholder arms facing each other. Said conventional rollholder arms 18 are typically mirror images of one another.

In a preferred embodiment, the bottomside 36 of the base 32 of each rollmount 30 adhesively attaches to the interior side of each rollholder arm 18 near the end 24 of the arm section and over the aforementioned depressions 26. The bottom side 36 preferably adhesively attaches to the interior side 20 of the rollholder arm 18 section with a double sided adhesive foam tape 79 such as the number 4932 Scotch Brand® from 3M® or an equivalent. Alternative embodiments may utilize any form of adhesive material which provides sufficient strength to hold said base 32 in position or any type of double sided adhesive tape which provides the same. Further alternative embodiments may attach the base 32 with screws, snaps, or by further modifying the base as described herein. Alternative embodiments of the base 32 include but are not limited to any shape or structure that provides an attachable surface for mounting the base 32 to a rollholder arm 18.

In a preferred embodiment, the hinged portion 48 of said base 32 is placed near but not at the front edge 38 of said base 32 and is molded with and attaches to the roll engaging arm 54 via the living hinge 52 and the return tensioner 78. The living hinge 52 is widely understood and utilized within the art of plastic molding. Said living hinge 52 is a plastic material bridge between the base 32 and said roll engaging arm 54 which allows flexing between the two portions without tearing or breakage of said bridge. Typically said living hinge is of a substantially thinner thickness than said base 32 or arm 54 and located near said front edge 38 in a direction toward the rear edge 42 of said base 32 and away from a bend 77 in said return tensioner 78.

The aforesaid return tensioner 78 further comprises a plastic material bridge between the base 32 and said roll engaging arm 54 having a bend 77 which forms it in a substantially "L" shape. It provides the necessary stiffness and flexing material memory for maintaining and positioning of the base 32 (plane of the topside 34 and bottomside 36) at a substantially right angle with said roll engaging arm 54 (plane of the front side 70 and rear side 72) on said living hinge 52. In a preferred embodiment, the return tensioner 78 is also of substantially thinner thickness than said base 32 or arm 54 but of a thicker thickness than said living hinge 52. Also in a preferred embodiment, said return tensioner 78 attaches within the slotted portion 40 of the base 32 and substantially near the axis of the living hinge 52. Said return tensioner 78 preferably attaches with said roll engaging arm 54 away from the axis of said living hinge 52, near the left end 60 yet toward right end 56 of said roll engaging arm 54, and within a slot 76 within said roll engaging arm 54.

In a first alternative embodiment, the apparatus comprises a base 32, a connector post 80 mounted onto and extending from the bottom side 36 of said base 32, a living hinge 52, a return tensioner 78, a roll engaging arm 54 and a retrofit plug 88, again preferably molded and formed together except for the retrofit plug 88. The connector post 80 is attached to the bottom side 36 of the rollmount base 32, preferably at the time of molding. Said connector post 80 provides a method of rollholder 12 attachment without the use of adhesives. The connector post 80 extends from said base 32 with a generally rectangular cross section but may have other polygonal cross sections. Said post 80 has a post connecting end 82 and a post attaching end 86 which is opposite the connecting end 82. Said post attaching end 86 preferably attaches to the bottom side 36 of the base 32. The post connecting end 82 preferably contains one or more lips 84 extending therefrom. The lips 84 on said connecting end 82 allow the connector post 80 to snap and hold into and with a retrofit plug 88.

The retrofit plug 88 comprises a generally cylindrical or rectangular piece of rubber or other elastomeric material, preferably a TPE plastic with a durometer near 70, having a cavity or hole 90 of substantially similar cross section as said connector post 80. Preferably, though not required, said retrofit plug 88 also has a plurality of ridges 94 on the cylinder's circumferential surface 92 and parallel with the cylindrical long axis. Said ridges 94 compressively engage the depression 26 of said rollholder arm 18 when said plug 88 is inserted within said depression 26. Alternate embodiments of said retrofit plug 88 include any type and shape of material that allows a secure insertion and hold of said plug 88 within the depression 26 of an existing rollholder arm 18 and further provides for insertion of said connector post 80.

A further alternative embodiment incorporates a sleeve 96, preferably formed from an elastomer material, having two oppositely facing pockets, that is a first sleeve pocket 98 and a second sleeve pocket 100, for mounting the rollmount 30 upon the rollholder arm 18. The base 32 of the rollmount 30 fits and is elastically held within the first sleeve pocket 98 and the rollholder arm 18 holder end 24 fits and is elastically held within the second sleeve pocket 100. This embodiment provides an alternative method of rollmount 30 attachment when the aforementioned methods are not desireable.

A still further alternative embodiment incorporates the aforementioned rollmounts 30 as part of a one piece substantially "U" shaped form 102 at the ends of the legs of the "U" shape. The "U" shaped form attaches within the cavity 14 created by the rollholder 12 and its arms 18, preferably with screws or adhesive. This embodiment and its advantages is best understood by reference to the aforementioned conventional rollholder 12. The conventional rollholder 12 forms a substantially "U" shaped form 102 between the interior sides 20 of the rollholder arm portions 18 and the wall or wall attaching section 16 of the rollholder 12. This further alternative embodiment provides a substantially "U" shape 102 which follows and substantially conforms to the contour of the aforesaid interior "U" or cavity 14 of the rollholder arms 18 and rollholder wall attaching section 16. This alternative embodiment "U" shape 102 may then be attached to the wall or wall attaching section 16 with adhesives, adhesive tape, or conventional fasteners such as screws, bolts, or pins. This alternative embodiment may also provide extensions which mate with the depressions 26 within the rollholder arms 18. This alternative embodiment functions and performs as the preferred embodiments.

In operation, the rollholder 12 having jointly or separately mounted rollholder arms 18, whether claimed as part of the apparatus 10 or as a separately non-claimed fixture or staple item, is attached to a wall or surface and oriented so that the interior sides 20 of the rollholder arms 18 face each other. The rollholder arms 18 are spaced horizontally at a length slightly longer than the length of the roll that will be inserted. The bottom side 36 of the base 32 of a rollmount 30 is then attached to the interior side 20 of each rollholder arm 18 in a position which usually covers the depression 26 in said rollholder arm 18 and allows the roll engaging arms 54 to flex toward said wall. Said attachment may be via adhesive, adhesive tape, or via the use of the alternative embodiment connector post 80 and retrofit plug 88 placed into said depression 26 of said rollholder arm 18. The rollmount 30 may also utilize the further alternative embodiment sleeve 96 with the elastic pockets 98, 100 placed over the holder end 24 of the rollholder arm 18 and the base 32 of the rollmount 30. When placed as anticipated and described, the front side 70 of said roll engaging arm 54 is facing away from the wall or surface on which the rollholder 12 is placed and said roll engaging arm 54 is capable of flexing toward said wall when pressed in said direction.

Once secured onto the rollholder arms 18, a roll of toilet paper or other roll material may be pushed between said rollholder arms 18, thereby flexing said roll engaging arms 54 of said rollmounts 30 toward said wall or surface. When the cylindrical cavity of the roll passes over the front side 70 of said roll engaging arm 54 of the rollmount 30, the return tensioner 78 causes said roll engaging arm 54 to retract away from said wall or surface and into said cylindrical cavity of said roll, whereby said roll is secured between the rollholder arms 18.

When the paper on the cylindrical roll is used, the user simply pushes said cylindrical roll toward the wall or surface in order to disengage the cylindrical roll from said roll engaging arms 54 of said rollmount 30. That is, when pushed as aforesaid, the roll engaging arms 54 flex toward said wall or surface and allow the cylindrical cavity of the roll to pass over the roll engaging arms 54 and thereby freeing or disengaging the empty roll from the roll engaging arms 54 of said rollmount 30. Once disengaged the empty roll may be discarded and a new roll may be inserted, all with the use of one hand. Obviously the foregoing provides significant benefits to those persons having use of only one hand.

From the foregoing description, those skilled in the art will appreciate that all objects of the present invention are realized. An apparatus and system for quickly inserting or removing and holding a roll of toilet paper along with its method of use has been shown and described. It has been shown to function usefully with paper dispensing rolls.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. An apparatus for quickly inserting or removing and holding a roll of paper comprising:

one or two rollmounts, each of said rollmounts comprising, a base having a topside, a bottom side, a front edge, a rear edge, a top edge, a bottom edge, and a base hinged portion near said front edge, a roll engaging arm having a right end, a left end, a top end, a bottom end, a front side, a rear side, and an arm hinged portion near said left end, a living hinge having an axis and mounted between said arm hinged portion and said base hinged portion, a return tensioner mounted near and between both said left end of said roll engaging arm and said front edge of said base, yet away from the axis of said living hinge, whereby said return tensioner allows said roll engaging arm to flex toward said topside of said base on said living hinge yet further causes said roll engaging arm to retract from said base and maintain the plane of the bottom side of said base at a substantially right angle with the plane of the front side of said roll engaging arm; and a rollholder having two rollholder arms attached to a wall attaching section, said rollholder arms each having an interior side, an exterior side, and a holder end opposite said wall attaching section, said bottom side of said base of said rollmount attached to at least one of said interior sides of said holder end.

2. The apparatus for quickly inserting or removing and holding a roll of paper as set forth in claim 1 further comprising:

a substantially "U" shaped form having legs formed by said "U" shape, said bottomside of said base of said rollmounts mounted upon each leg of said "U" shaped form; and said rollholder having said two rollholder arms forming a cavity, said "U" shaped form attached within said cavity created by said rollholder and said arms whereby said roll engaging arm flexes toward said topside of said base when a roll of paper is pushed within said cavity.

3. The apparatus for quickly inserting or removing and holding a roll of paper as set forth in claim 1 whereby:

said bottom side of said base of said rollmount is attached to said interiors side of said holder end with an adhesive material.

4. The apparatus for quickly inserting or removing and holding a roll of paper as set forth in claim 3 whereby:

said adhesive material is a double sided adhesive foam tape.

5. The apparatus for quickly inserting or removing and holding a roll of paper as set forth in claim 1 whereby:

said bottom side of said base of said rollmount is attached to said interior side of said holder end with an elastomeric sleeve, said sleeve having a first sleeve pocket and a second sleeve pocket, each oppositely facing, said base of said rollmount elastically held within said first sleeve pocket and said rollholder arm holder end elastically held within said second sleeve pocket.

6. The apparatus for quickly inserting or removing and holding a roll of paper as set forth in claim 1 further comprising:

a slotted portion in said front edge of said base; and a slot in said left end of said roll engaging arm, and a bend in said return tensioner, whereby said mounting of said return tensioner near and between both said left end of said roll engaging arm and said front edge of said base is within said slotted portion in said front edge of said base and within said slot in said left end of said roll engaging arm.

7. The apparatus for quickly inserting or removing and holding a roll of paper as set forth in claim 1 whereby:

said top end and said bottom end of said roll engaging arm are rounded.

8. The apparatus for quickly inserting or removing and holding a roll of paper as set forth in claim 1 further comprising:

one or more connector posts each having a post connecting end and a post attaching end, said post attaching end attached to said bottom side of said base.

9. The apparatus for quickly inserting or removing and holding a roll of paper as set forth in claim 8 further comprising:

said roll holder arms each having a depression within said interior side of said holder end; and a retrofit plug of elastomeric material having a circumferential surface positioned within at least one of said rollholder arm depressions, said retrofit plug having a cavity capable of elastomerically holding a substantial portion of said connector post, said connector post connecting end located within said cavity whereby said connecting end is elastomerically held within said cavity.

10. The apparatus for quickly inserting or removing and holding a roll of paper as set forth in claim 9 further comprising:

one or more ridges on said circumferential surface of said retrofit plug.

11. An apparatus for quickly inserting or removing and holding a roll of paper comprising:

two rollmounts, each of said rollmounts comprising, a base having a topside, a bottom side, a front edge, a rear edge, a top edge, a bottom edge, and a base hinged portion near said front edge, a roll engaging arm having a right end, a left end, a top end, a bottom end, a front side, a rear side, and an arm hinged portion near said left end, a living hinge having an axis and mounted between said arm hinged portion and said base hinged portion, a return tensioner mounted near and between both said left end of said roll engaging arm and said front edge of said base, yet away from the axis of said living hinge, whereby said return tensioner allows said roll engaging arm to flex toward said topside of said base on said living hinge yet further causes said roll engaging arm to retract from said base and maintain the plane of the bottom side of said base at a substantially right angle with the plane of the front side of said roll engaging arm; and a rollholder having two rollholder arms attached to a wall attaching section, said rollholder arms each having an interior side, an exterior side, and a holder end opposite said wall attaching section, said bottom side of said base of each of said rollmounts attached to said interior side each of said holder ends.

12. A method for quickly inserting or removing and holding a roll of paper, the steps comprising:

molding two rollmounts, the steps of molding each of said rollmounts comprising;

forming a base having a topside, a bottom side, a front edge, a rear edge, a top edge, a bottom edge, and a base hinged portion near said front edge, forming a roll engaging arm having a right end, a left end, a top end, a bottom end, a front side, a rear side, and an arm hinged portion near said left end, connecting a living hinge having an axis between said arm hinged portion and said base hinged portion, connecting a return tensioner near and between both said left end of said roll engaging arm and said front edge of said base, yet away from the axis of said living hinge, whereby said return tensioner allows said roll engaging arm to flex toward said topside of said base on said living hinge yet further causes said roll engaging arm to retract from said base and maintain the plane of the bottom side of said base at a substantially right angle with the plane of the front side of said roll engaging arm; and attaching said bottom side of said base of each rollmount to an interior side of each of two rollholder arms of a rollholder each near a holder end; and pushing said roll of paper between said rollholder arms, thereby flexing said roll engaging arms toward said topside of said base until said roll engaging arms retract into a cylindrical cavity of said roll of paper; and using said roll of paper until depleted; and pushing said roll of paper between said rollholder arms, thereby flexing said roll engaging arms toward said topside of said base until said roll engaging arms retract out of said cylindrical cavity of said roll of paper whereby said roll of paper is removed from said rollmounts.

13. The method for quickly inserting or removing and holding a roll of paper, as set forth in claim 12, the method for attaching said bottom side of said base further comprising:

forming a substantially "U" shaped form having said base of each of said rollmounts integrally attached to said "U" shaped form; and attaching said "U" shaped form between said two rollholder arms of said rollholder.

14. The method for quickly inserting or removing and holding a roll of paper, as set forth in claim 12, the method for attaching said bottom side of said base further comprising:

placing an adhesive material on said bottom side of said base and said interior side of said rollholder arm of said rollholder near said holder end.

15. The method for quickly inserting or removing and holding a roll of paper, as set forth in claim 12, the method for attaching said bottom side of said base further comprising:

attaching a connector post to said bottom side of said rollmount; and molding two retrofit plugs, each having a circumferential surface capable of positioning within a depression within said rollholder arms and a cavity capable of elastomerically holding a substantial portion of said connector post; and pushing said retrofit plug into said depression; and pushing said connector post within said cavity whereby said connector post is elastomerically held within said cavity.

16. The method for quickly inserting or removing and holding a roll of paper, as set forth in claim 12, the method for attaching said bottom side of said base further comprising:

forming two elastomeric sleeves, each having a first sleeve pocket and a second sleeve pocket, each oppositely facing, stretching said first sleeve pocket over said base of said rollmount; and stretching said second sleeve pocket over said rollholder arm of said rollholder near said holder end whereby each rollmount is elastically held to each rollholder arm.

* * * * *